US007607452B2

(12) United States Patent
Kühbauch et al.

(10) Patent No.: US 7,607,452 B2
(45) Date of Patent: Oct. 27, 2009

(54) VALVE CONSTRUCTION KIT FOR THE PRODUCTION OF VALVE CLUSTERS

(75) Inventors: Heiko Kühbauch, Köngen (DE); Michael Berner, Kichheim (DE)

(73) Assignee: Festo AG & Co., Esslingen (DE)

( * ) Notice: Subject to any disclaimer, the term of this patent is extended or adjusted under 35 U.S.C. 154(b) by 103 days.

(21) Appl. No.: 11/605,075

(22) Filed: Nov. 28, 2006

(65) Prior Publication Data

US 2007/0137708 A1 Jun. 21, 2007

(30) Foreign Application Priority Data

Dec. 21, 2005 (EP) ..... 05028026

(51) Int. Cl.
*F15B 13/00* (2006.01)

(52) U.S. Cl. ..... 137/269; 137/271; 137/884

(58) Field of Classification Search ..... 137/269, 137/271, 884

See application file for complete search history.

(56) References Cited

U.S. PATENT DOCUMENTS 5,666,994 A 9/1997 Stoll et al.
6,138,717 A 10/2000 Meyer
6,213,153 B1 * 4/2001 Hayashi et al. ..... 137/884
7,191,800 B2 * 3/2007 Berner et al. ..... 137/884
2001/0009165 A1 7/2001 Notz et al.
2005/0236054 A1 10/2005 Miyazoe et al.

FOREIGN PATENT DOCUMENTS

DE 39 17 242 10/1990
DE 195 08 011 9/1995
EP 0 678 676 10/1995

* cited by examiner

*Primary Examiner*—Kevin L Lee
(74) *Attorney, Agent, or Firm*—Hoffmann & Baron, LLP

(57) ABSTRACT

A valve construction kit is provided for the production of valve clusters respectively having several juxtaposed plate-like valve units. Each valve unit comprises a core module having a valve spool and a frame-like encasing element surrounding the core module. The construction kit furthermore comprises several encasing elements differing at least as regards the consistency of the their material and of different types so that it is possible to produce valve units for different applications owing to the selected combination with core modules.

18 Claims, 2 Drawing Sheets

VALVE CONSTRUCTION KIT FOR THE PRODUCTION OF VALVE CLUSTERS

BACKGROUND OF THE INVENTION

The invention relates to a valve construction kit for the production of valve clusters, which have plate-like valve units extending in a row across their principal plate plane.

THE PRIOR ART

The European patent publication EP 0678676 B1 describes a valve cluster comprising a plurality of juxtaposed plate-like valve units respectively having a valve housing containing a valve spool and having electrically operated pilot valves for activating the associated valve spool. The individual valve units are seated between two end plates and are held together by a plurality of ties.

A solenoid valve cluster disclosed in the German patent publication DE 3917242 A1 comprises valve units placed in a row athwart its principal plate plane and each having a frame-like base, through which a plurality of valve ducts extend and which delimits an inner space, in which the solenoid valves in the base are located. The inner space furthermore contains a printed circuit board connected with the solenoid valves.

A solenoid valve unit disclosed in the German patent publication DE 19508011 C2 comprises a valve body, through which valve ducts extend and which is fitted with a plurality of solenoid valves, which are surrounded by a frame mounted on the valve body, such frame functioning as a carrier for an electrically conductive and a cover.

The prior art valve clusters are to a certain extent of universal application and consequently suitable for different conditions of use. If exceptional conditions apply for the site of use which might impair functionality, as for instance high temperatures, aggressive media or the like, different remedies are necessary, as for example accommodating the entire valve cluster with suitable protective means in a cabinet or placing the valve cluster at some distance from the actual site of use and providing piping of suitable length for the operating devices to be actuated.

SHORT SUMMARY OF THE INVENTION

One object of the invention is to evolve measures leading to economic production of valve clusters suitable for specialty applications.

In order to achieve these and/or other objects appearing from the present specification, claims and drawings, the present invention provides a valve construction kit for the production of valve clusters which have plate-like valve units extending in a row across their principal plate plane and which possess a respective core module having a core housing through which a plurality of valve ducts extend and which contains at least one movable valve spool, said valve units also possessing a frame-like encasing element, separate from the core module, and which surrounds the core module with a relevant definition of the outline of the valve unit in the principal plate plane, said encasing element and the core module being fixed together by mutually matching interface means, the construction kit containing a plurality of core modules and a plurality of frame-like encasing elements, differing from each other at least in their material properties, of different types, whose interface means are matched to each other so that owing to the selected combination of core modules with encasing elements of different types valve units may be produced for different purposes of use.

Accordingly there is now the possibility of selecting, in accordance with the desired purpose of application, the casing constituted by the encasing elements for production of a valve cluster and therefore of individually creating the valve clusters. For instance, it is possible, in order to ensure wide ranging and universal applications to have recourse to encasing elements, which consist of low price material, by way of example a plastic material, of moderate strength suitable for easy processing. If on the other hand it is a question of rendering the valve cluster more particularly resistant to aggressive media, as for example chemicals or cleaning agents, it is possible for example to resort to encasing elements, which consist a highly resistant plastic material or of metal or a composite material. Furthermore by having different colors it is possible to indicate the respective material properties and accordingly the possibilities of use of the assembled valve cluster. It is an advantage that, independently of the type of encasing element employed, i.e. independently of its material properties, it is possible to resort to similar core modules so that no modifications will be necessary for the components responsible for the functionality of the valve cluster and the various individual possibilities of application can be taken into account simply by the selection of the encasing elements, which as such are able to be manufactured at a relatively economic price. Nevertheless there is naturally still the possibility of a combination of the various encasing elements with core modules of different functionality, the similar interface means serving to ensure that even in such a case it is possible to resort to encasing elements of different types standardized as regards their interface means.

Further advantageous developments of the invention are defined in the claims.

A particular advantage of the invention will become apparent in the case of a valve construction kit having a plurality of mutually identical core modules, that is to say core elements of different types, which on the basis of mutually matched interface means may be combined alternatively with encasing elements of different types, that is to say having different material properties. Accordingly there is now the possibility of alternatively customizing, simply by the selection of a suitable type of encasing elements, valve clusters which as regards their functionality and their structure are completely identical and merely differ as regards the consistency of their material of their outer casing.

Some or all of the different types of encasing elements, which differ from each other as regards the properties of their materials, may possess an at least generally similar outline and by way of example can be completely identical. However there is the possibility of several types of the encasing elements present in the valve construction kit, or by themselves, being different as regards at least one feature other than such material properties, for example as regards the presence or absence of electrical input and output connections. Here it is to be observed that the valve construction kit may certainly have module units, which while not complying with the design of the valve units so far discussed are however nevertheless able to be combined with these valve units to form a valve cluster. This will more particularly apply for the terminal units, terminating the valve cluster at the end or side or for purely electrical module units.

As a rule the core modules will be designed for electrical operation. More particularly in such a case it is an advantage for the interior space, delimited by the encasing elements in each case, to possess a larger cross sectional area than the encased core module, in the assembled state of the valve unit so that within the encasing element in addition to the core module there is at least one free space able to be termed a "working space", which by way of example may be utilized for the accommodation electrical concatenating means or electronic control circuitry, serving for the electrical control of the valve units.

The interface means present inside the valve units for fixation between the encasing element and the core module may at least in part be designed as detent connection means so that the encasing element may be mounted, more particularly in a detachable fashion as well, on the core module. It may however be convenient in some circumstances to provide additional screw connection means or to exclusively employ such screw connection means.

In order to prevent the entry of dirt into the portion between two valve units engaging each other, seal means may be present placed in the joint portion of the two juxtaposed encasing elements. Fitting then becomes particularly simple if the seal means are arranged directly on the encasing elements and form a simple structural assembly with them.

Further advantageous developments and convenient forms of the invention will be understood from the following detailed descriptive disclosure of embodiments thereof in conjunction with the accompanying drawings.

LIST OF THE SEVERAL VIEWS OF THE FIGURES

FIG. 1 shows on the left a valve cluster built using a valve construction kit with a preferred arrangement of the type in accordance with the invention while on the right-hand side there are a plurality of encasing elements comprised in the basic valve construction kit for the alternative use in the case of the assembly of the valve cluster, and in the background one of several core modules of the valve construction kit.

DETAILED ACCOUNT OF WORKING EMBODIMENTS OF THE INVENTION

Figure 1:
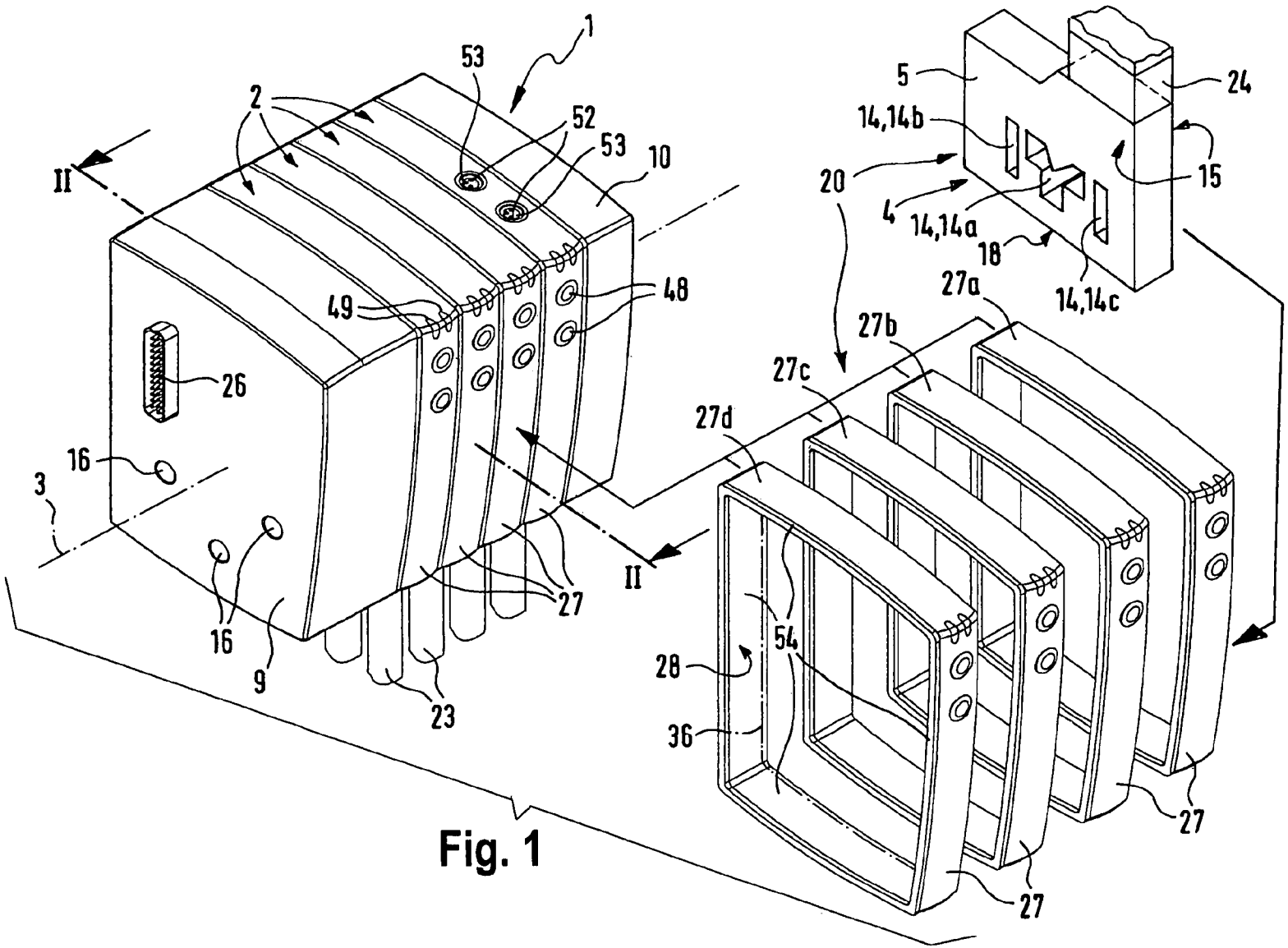
Figure 3:
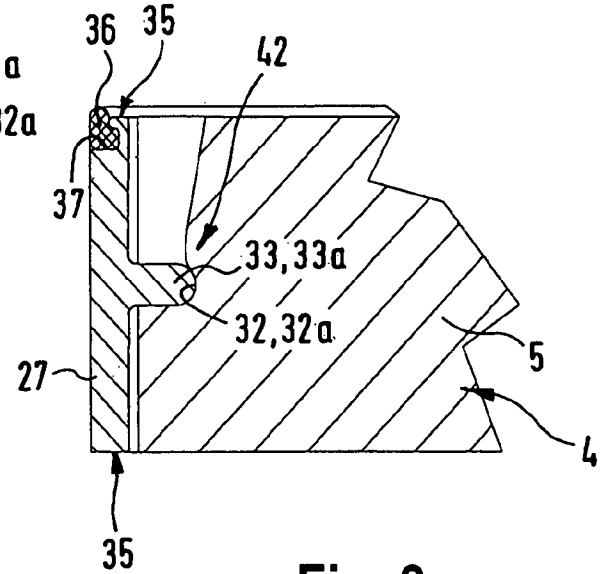
FIG. 3 shows on a larger scale a detail of the interface means, present in the illustrated arrangement, in accordance with the section line III-III of FIG. 2.

The left hand half of FIG. 1 indicates a valve cluster 1, as may be produced using an inventive valve construction kit 20 with a preferred assortment of items. The valve cluster 1 comprises a plurality of valve units 2, in the example there are four, one being depicted in FIG. 2 in a longitudinal section on the section line II-II, the section plane coinciding with the principal plate plane of the respective valve unit 2.

The various valve units 2 are juxtaposed athwart the principal plate plane in a row direction 3, indicated in chained lines, with their outlines aligned with each other. For the end termination of the valve cluster 1 there are two plate-like or block-like terminal units 9 and 10, the entire assembly being held together by way of example by ties, not illustrated in detail, more particularly detachably.

Figure 2:
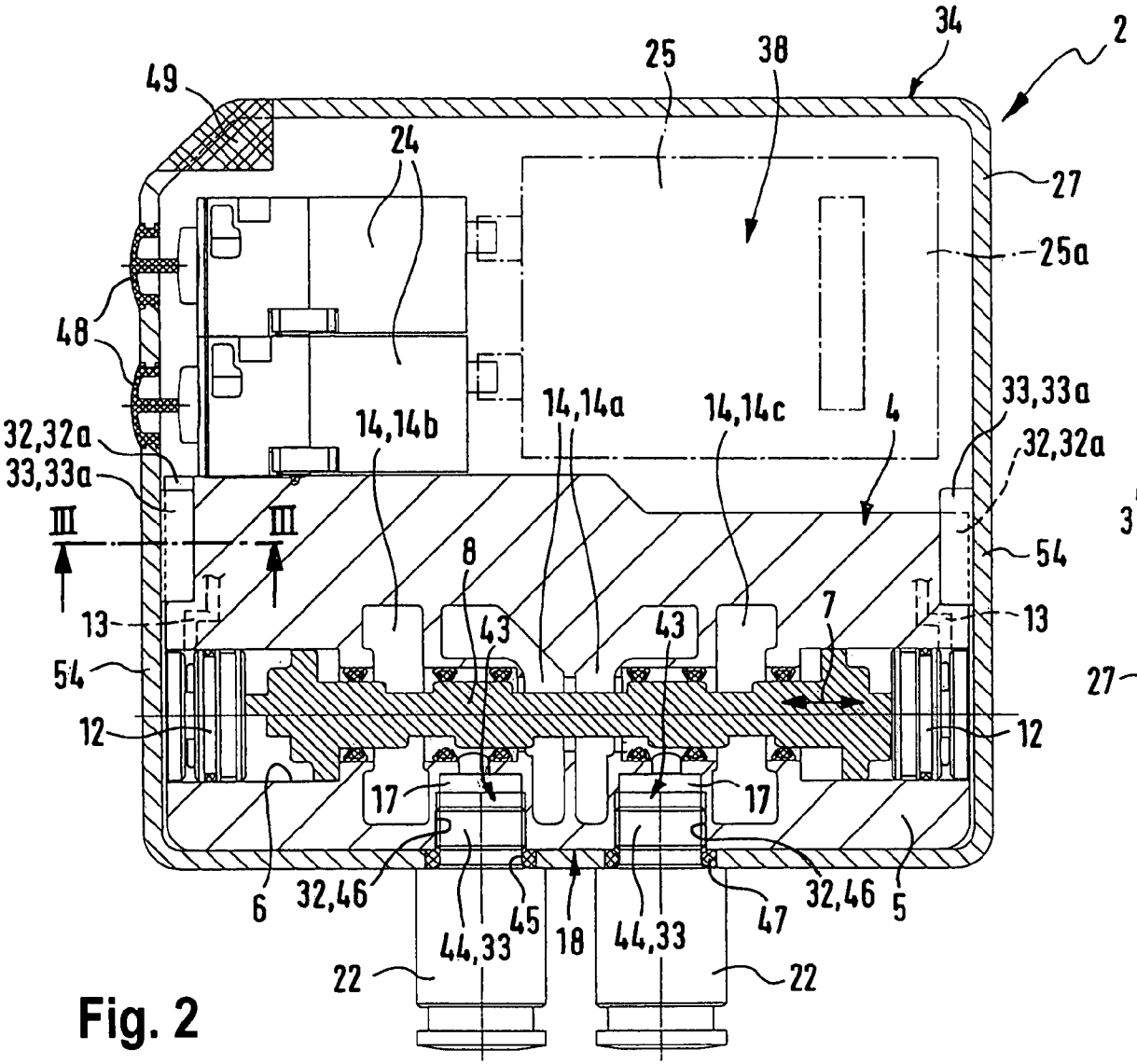
FIG. 2 shows a cross section, which in many parts is diagrammatic, taken through the valve cluster of FIG. 1 on the section line II-II therein.

The various valve units 2 respectively comprise a core module 4, which is illustrated in section in FIG. 2 and in FIG. 1 diagrammatically as a component of the valve construction kit 20, such module 4 preferably having an essentially plate-like core housing 5, whose principal plane of extent coincides with the principal plate plane.

The core housing 5, which in principle in the working example comprises metal, contains an elongated valve spool space 6 extending athwart the row direction 3, in which a valve spool 8 arranged to reciprocate linearly as indicated by the double arrow. Drive elements 12, which are for example piston-like, are arranged at the end of the spool 8 and may be subjected to a pressure medium by way of merely diagrammatically indicated control ducts 13 in order to shift the valve spool 8 into the desired switching position.

The core housing 5 has a plurality of valve ducts 14 extending through it in the row direction 3. Such ducts extend at a right angle to the respective principal plate plane and open respectively at mutually opposite housing principal plate faces 15. As a rule the valve ducts 14, orientated in the row direction 3, will have a feed duct 14*a* placed centrally between two venting openings 14*b* and 14*c*. A reversed arrangement would however also be possible.

When the valve cluster 1 is assembled corresponding valve ducts 14 of the juxtaposed valve units 2 are mutually aligned and form through ducts extending right through the entire valve cluster 1 in its longitudinal direction and opening on one or both connection units 9 and 10. Here the pressure medium utilized in the operation of the valve cluster 1, in particular compressed air, may be centrally supplied and vented. In the working embodiment the connection openings are located at the end on the connection unit. As an alternative peripheral placement would be possible.

The valve ducts 14 and accordingly the through ducts composed thereof communicate within the core housing 5 with the valve spool space 6 respectively formed therein. This is more particularly made possible because the valve ducts 14 so extend through the associated core housing 5 that they intersect with the valve spool space 6.

Furthermore two power ducts 17 also extend in each core housing 5, which at one end communicate with the valve spool space and at the other open at an edge face 18, at a right angle to the housing principle faces 15, of the core housing 5. Here they are provided with a connection means 22, which renders possible the preferably detachable connection of a fluid duct 23, which leads to a load, not illustrated, to be actuated by means of the valve cluster 1, for example a fluid operated drive.

In accordance with the respective switching position of the valve spool 8 pressure medium entering by way of the supply duct 14*a* may leave by way of a power duct 17 or pressure medium flowing back via one of the venting ducts may be let off by one of the venting ducts 14*b* and 14*c*. In this case it is a question of a conventional mode of operation of a valve so that further explanations are unnecessary at this point.

In the working embodiment the respective core module 4 is also provided with electrically actuated pilot valves 24, for example solenoid valves or piezoelectric valves, arranged at the edge on the core housing 5. They receive their electrical actuating signals via an electrical concatenating means 25 which extends in the row direction 3, is only diagrammatically illustrated and is able by way of an electrical interface 26, arranged on at least one of the connection units 9 and 10, to communicate with an electronic control means.

Dependent on their operational state the pilot control valves 24 may set the fluid action in the control ducts 13 and accordingly the switching position of the valve spool 8. The fluid control medium may be in this case tapped within the core housing 5 from the supply duct 14*a* or as an alternative can be supplied by way of one or more separate pilot ducts extending through the core housing 5.

The electrical concatenation means 25 is preferably divided up into concatenation modules 25*a*, of which one respective one is located on board a respective valve unit 2 and which make contact with one another, when the valve units 2 are moved together to produce the cluster-like assembly.

Between the valve units 2 adjacent to mutually facing housing principal faces 15 of the core housing 5 there are sealing means, not illustrated in detail, which ensure a leak-proof connection of the valve ducts 14 of the respectively assembled valve units 2.

Besides the already mentioned valve-related components each valve unit 2 comprises a frame-like encasing element 27. The encasing element 27 is a component separate from the associated core module 4 and delimits a receiving space 28 having a width equal to the maximum width of the associated core module 4, in which receiving space the core module 4 is accommodated. The core module 4 is hence surrounded at its edge faces 18 peripherally by the associated encasing element 27. Using matching interface means 32 and 33 the encasing element 27 and the core module 4 are secured together to constitute a respective valve unit 2 while forming an assembly as the valve unit 2.

The outline 34 (of a respective valve unit), well depicted in FIG. 2 and to be seen looking in the row direction 3, is largely set by the encasing element 27. It could also be said that the encasing elements 27 respectively constitute the outer casing of the respective valve unit 2, which surrounds and protects the core module 4.

With the valve cluster 1 assembled the frame-like encasing elements 27, forming closed loops, have their edge faces 35 in mutual engagement and accordingly jointly encapsulate the core modules 4 contained in them. The termination at the end is performed by the above mentioned connection units 9 and 10, whose outline is the same as that of the encasing elements 27 so that there is a direct connection.

Directly juxtaposed valve units 2 are preferably provided with seal means 36 effective between them in the joint portion of adjacent encasing elements 27 so that even in unfavorable conditions of the surroundings there is no ingress of dirt and the type of protection necessary for the sort of operation is ensured. The sealing means 36 may be separate components, which during assembly of the valve cluster 1 are placed between respective one of the units 2, 9 and 10 and the nest following one. It is however more advantageous to resort to the measure adopted in the working example, where the sealing means are directly borne by the encasing elements 27 and constitute a single assembly unit able to be conveniently handled. The sealing means 36 may by way of example be molded on the associated encasing element 27 or also be joined to it by an adhesive bond. A design is depicted in which the sealing means 36 are held in an anchoring groove 37 in the associated encasing element 27.

The valve construction kit 20 here in question comprises all components necessary for the production of one or more valve units 2, with the particular feature that several encasing elements 27, illustrated in FIG. 1 on the left, of different type are present. The different selection of different types is based on the different consistency of the material of such encasing elements 27. Each of these encasing elements 27 of different type differs from the other encasing elements 27 as regards the material of which it is manufactured.

It will be clear that of the encasing elements of different type in each case there is a fair number; as shown in FIG. 1 by way of example only one representative of the encasing elements 27 of different type is illustrated. The number of the similar encasing elements 27 present in a valve construction kit will be so selected that using the encasing elements 27 of each type at least one valve cluster 1 may be made, whose valve units 2 are then fitted with the encasing elements 27 of the same type.

The valve construction kit 20 of the example furthermore comprises a plurality of mutually identical core modules 4 of which one is represented in FIG. 1 by way of example. The number of the core modules 4 present will be at least equal to the number required for the production of at least one valve cluster 1.

Irrespectively of their type the various different encasing elements 27 are designed with identical interface means 33, something which also applies in the same fashion for the interface means 32 of the core modules 4. It is in this manner that each core module 4 can be selectively combined with an encasing element 27 of any one of the types present and assembled together as a valve unit 2. Thus there is the possibility of using a selection of combinations of encasing elements 27 having similar interface means 32 and 33 and of a selected type and core modules 4 to make valve units 2 for different applications and to assemble a valve cluster therewith.

The valve construction kit 20 of the working example comprises by way of example four different types of encasing elements 27, which are respectively present in a number (not illustrated), since a suitable number thereof stocked. The encasing element 27 and 27*a* of a first type, which by way of example was employed for producing the illustrated valve cluster 1, is made of stainless steel. A second encasing element type 27*b*, which is available, consists of aluminum material. A third encasing element type 27*c* is made of plastic material of average quality, which is suitable, like the aluminum design, for a plurality of applications in a universal manner. The fourth encasing element type 27*d* consists of a particularly chemically resistant material of high quality.

On fitting together a valve cluster 1 the manufacturer therefore has the possibility of individually selecting the type of encasing element in order to thus provide a specific adaptation to the respective application in hand. The as a rule relatively complexly designed core modules 4, whose production is expensive, may therefore always be the same and it is only the different types of encasing elements 27 which are changed.

However the different encasing elements 27 may also be selectively combined with different types of core modules 4. It is only necessary to ensure the provision of functionally matching interface means 32 and 33 and corresponding outlines. While therefore the core module 4 illustrated in the figure is designed with two pilot control valves 24, it would by way of example be possible to have a design with only one pilot control valve and a spring return means for the valve spool 8. There are consequently practically no limits to possible combinations.

In the case of the valve construction kit 20 of the working example encasing elements 27 consisting both of metal and also of plastic material are present. Instead of this however types of the encasing elements 27 could be included which are either metallic or non-metallic. Furthermore within the respectively identical types of material any desired variations are possible, i.e. metal or plastic. Moreover, composite materials could be utilized.

The different types of encasing elements 27 could differ from each other as regards their outline. This could be the result for example of a greater wall thickness being desired for plastic material encasing elements for reasons of rigidity than is the case with a metal design. As a rule however in the case of all designs a minimum wall thickness will be strived at.

In the working embodiments illustrated the frame-like encasing elements 27 are respectively in the form of rectangular frames, there nevertheless being the possibility of some or all of the four frame sections 54 possessing a slightly convex outline, as is illustrated by way of example in FIG. 1.

It is possible for the encasing elements 27 to be designed with a configuration matching the configuration of the core modules 4 and also with a different frame shape, for example any possible polygonal shape or round shapes, be they circularly round or oval for example.

In the working embodiment the encasing elements 27 possess the same width in the row direction 3. However, different overall widths would be possible within one and the same valve cluster 1.

As may be seen from FIG. 2, in the case of the use of the above mentioned electrical concatenation means 25 it is possible to resort to encasing elements 27, in the case of which their receiving space 28, looking in the row direction 3, possess a larger cross sectional area than the surrounded core module. Accordingly there remains a working space 38, not occupied by the core module 4, able to accommodate the electrical concatenation means 25.

In the working embodiment the encasing elements 27 are completely open in a direction athwart the principal plate plane. In particular for optimizing the attachment of the core module 4 containing the valve mechanism there is however also the possibility of providing elements inwardly extending from of the frame sections 54 in a direction athwart the row direction 3, such elements being able to function as support elements or support walls, against which the core module 4 may be caused to abut. Furthermore for stiffening the frame structure stiffening elements could be provided between individual frame sections 54 or several thereof, more particularly near one of the edge faces 35, which extend through the face surrounded by the encasing element 27.

As regards the mutual attached of the encasing element 27 and the core module 4 within a respective valve unit 2, in the case of the working example resort has been had to interface means 32 and 33, which represent a combination of detent connection means 42 and screw connection means 43.

During assembly using the detent connection means 42 a preliminary fixing operation may be performed for the components to be coupled. Detent attachment is preferably performed by insertion of the previously assembled core module 4 at a right angle to the principal plate plane into the receiving space 28. In this case several detent projections 33*a*, extending from the frame sections 54 of the encasing element 27 extending into the receiving space 28, come into fitting engagement with complementary detent recesses 32*a* in the core housing 5. The arrangement of the detent projections and detent recesses may naturally also be selected the other way round.

In order to prevent mutual skew running of the component there is preferably a provision such that with the detent connection means 42 in mutual engagement, the core housing 5 has its edge face 18 at least partially supported on the inner face of the frame-like encasing element 27.

The final attachment in position is provided for by the above mentioned screw connection means 43. They are preferably in the form of connection means 22, having a threaded pipe 44 which respectively extends through a through hole 45 in the encasing element 27 and are screwed by means of a female thread on an end section 46 of the power duct 17 opening here. Annular sealing elements placed at the respective opening 45 serve to seal off the screw connection so that it is not possible either for pressure medium from the valve ducts to escape or for dirt to find its way via the through holes into the receiving space 28.

Alternatively or in addition a screw connection, not dependent on the connection means 22, could be provided between the encasing element 27 and the core housing 5. There is furthermore the possibility of designing the interface means 32 and 33 exclusively in the form of detent connection means or as screw connection means.

Apart from the different material consistency the various types of encasing element 27 may be otherwise completely identical or differ from one another additionally as regards at least one further feature.

In agreement with each other in the working example all encasing elements 27 are furnished with manual actuating means 48, by way of example key respectively inserted in an opening in the encasing element 27, such key being able to cooperate with the pilot control valve 24 for the purpose of selective manual activation. As a further shared feature is that in the working embodiment inspection windows (in the form of transparent bodies 49) are inserted in the encasing element 27 and are provided in each encasing element 27, which by making visible a light means, not illustrated in detail, of the core module 4 serve for inspection of the current switching state of a respective valve unit 2 from the outside.

As a modified feature of the design in the case of the valve cluster 1 of the working embodiment electrical input and/or output terminals 52 are provided additionally on at least one valve unit 2, which are electrically connected with the encasing element 4 or with the concatenation module 25*a* of the respective valve unit 2. They are inserted in openings 53 of one of the four frame section 54 of the respective encasing element 27.

In the case of other design features as well the valve units 2 may differ from each other as regards their core modules 27 and also as regards their encasing elements 27. Owing to the provision of a corresponding number of principally usable types of encasing elements 27 all in all an extremely adaptable valve construction kit is achieved.

The invention claimed is:

1. A valve construction kit for the production of valve clusters, said valve clusters comprising plate-like valve units arranged in a row in a direction at right angle to a principal plate plane of each valve unit said valve units each possessing a core module having a core housing through which a plurality of valve ducts extend at right angle to the respective principal plate plane and which contains at least one movable valve spool, said valve units also possessing a frame-like encasing element, separate from the core module, said encasing element surrounding the core module in the principal plate plane and defining an outline of the respective valve unit, said encasing element and the core module being fixed together by mutually matching interface means, the construction kit containing a plurality of said core modules and a plurality of frame-like encasing elements of different types, said frame-like encasing elements of different types differing from each other at least in their material properties, wherein the mutual interface means permit assembly of valve units for different purposes of use.

2. The valve construction kit as set forth in claim 1, wherein at least two different types of encasing elements are present, which include different plastic material.

3. The valve construction kit as set forth in claim 2, wherein said at least two different types of encasing elements are made of plastic material of different strength.

4. The valve construction kit as set forth in claim 1, wherein at least two different types of encasing elements are present, which are made of different metals.

5. The valve construction kit as set forth in claim 4, wherein said at least two different types of encasing elements are made on the one hand of aluminum material and on the other hand of stainless steel.

6. The valve construction kit as set forth in claim 1, wherein at least two different types of encasing elements are present, which are made of plastic material in one case and of metal in another case.

7. The valve construction kit as set forth in claim 1, wherein said plurality of core modules are identical and are able to be combined with said encasing elements of different types.

8. The valve construction kit as set forth in claim 1, wherein a plurality of different types of encasing elements possess an at least substantially identical outline.

9. The valve construction kit as set forth in claim 1, wherein at least two encasing elements of different types are differing from each other as regards the presence and absence of electrical input and/or output terminals.

10. The valve construction kit as set forth in claim 1, wherein the core modules at least in part are fitted with a an electrically actuatable pilot control valve.

11. The valve construction kit as set forth in claim 10, wherein the at least one electrically actuatable pilot control valve is mounted externally on the core housing, it being surrounded by the encasing element respectively secured to the core housing as well.

12. The valve construction kit as set forth in claim 1, wherein each encasing element delimits a receiving space having a larger cross sectional area in the principal plate plane than the core module so that a utility space is defined in-between which is able to be utilized for any purpose if necessary.

13. The valve construction kit as set forth in claim 12, wherein the utility space is able to be used to receive components of an electrical concatenation means serving for the electrical concatenation of juxtaposed valve units.

14. The valve construction kit as set forth in claim 1, wherein the interface means present for mutual attachment together of the encasing element and the core module comprise detent connection means.

15. The valve construction kit as set forth in claim 14, wherein the detent connection means are so designed that the encasing element is able to be secured with a detent action by movement onto the associated core module from the side in the direction of the row of the valve units.

16. The valve construction kit as set forth in claim 1, wherein the interface means for mutually securing the encasing element and the core module are at least partly in the form of a screw connection means.

17. The valve construction kit as set forth in claim 1, comprising sealing means for providing a seal between juxtaposed valve units in a joint area of the encasing elements.

18. The valve construction kit as set forth in claim 17, wherein the sealing means are directly borne by the encasing elements themselves and constitute an assembly unit therewith.

* * * * *